US005423387A

United States Patent [19]

Lynde

[11] Patent Number: 5,423,387

[45] Date of Patent: Jun. 13, 1995

[54] METHOD FOR SIDETRACKING BELOW REDUCED-DIAMETER TUBULARS

[75] Inventor: Gerald D. Lynde, Houston, Tex.

[73] Assignee: Baker Hughes, Inc., Houston, Tex.

[21] Appl. No.: 81,569

[22] Filed: Jun. 23, 1993

[51] Int. Cl.[6] ..... F21B 7/08

[52] U.S. Cl. ..... 175/61; 166/117.5

[58] Field of Search ..... 166/50, 285, 117.5, 166/117.6, 242; 175/61

[56] References Cited

U.S. PATENT DOCUMENTS

| | | | |
|---|---|---|---|
| 2,173,035 | 9/1939 | Armentrout et al. | 175/61 |
| 4,153,109 | 5/1979 | Szescila | 166/250 |
| 4,285,399 | 8/1981 | Holland et al. | 166/113 |
| 4,304,299 | 12/1981 | Holland et al. | 166/255 |
| 4,307,780 | 12/1981 | Curington | 166/113 |
| 4,397,355 | 8/1983 | McLamore | 166/297 |
| 5,277,251 | 1/1994 | Blount et al. | 166/117.5 |
| 5,301,760 | 4/1994 | Graham | 166/285 X |

*Primary Examiner*—David J. Bagnell
*Attorney, Agent, or Firm*—Rosenblatt & Associates

[57] ABSTRACT

The apparatus and method of the present invention facilitate the initiation of lateral bores from a main wellbore in a completed well having a packer and a tubing string. The preferred method involves setting a plug, which may be removed, through the tubing string, followed by a layer of sand, followed by a layer of cementitious material or other material that becomes hard. The cementitious material is drilled from the end of the production tubing by means of equipment passed through the length of the cementitious material. This allows running in with another packer or anchoring device to be located within the newly created bore in the cementitious material. The sidetracking device is secured to the anchoring device and oriented. The milling then proceeds with a high-efficiency milling tool that creates a window through the cementitious material and outer casing. A milling assembly can then be used to complete the window and begin the lateral bore. If subsequent bottom production is required, the cementitious material can be underreamed down to the sand. The sand can then be washed from the initial plug that was set to support the cementitious material in the original wellbore. Multiple laterals can be accomplished in this manner by repeating the process steps.

20 Claims, 2 Drawing Sheets

METHOD FOR SIDETRACKING BELOW REDUCED-DIAMETER TUBULARS

FIELD OF THE INVENTION

The field of the invention relates to devices and methods to allow drilling of deviated bores from existing wellbores.

BACKGROUND OF THE INVENTION

Wells are desirably drilled into formations bearing oil and gas. These producing formations can occur at different depths and have irregular shapes, making some portions of a producing zone larger at some depths in the wellbore than at others. Occasionally, after a well is drilled and completed, the perforated zone begins to produce marginally or not at all. It is then desirable to be able to tap into the same producing zone in a different depth or location, or to continue the wellbore and/or to deviate in a different direction into a totally different zone to a different depth.

In the past, technology has been developed to allow deviation of wellbores so that when drilling a new well, several lateral bores can be made to improve the overall penetration into the producing zone. While these advances in directional drilling have made it possible to produce multiple lateral bores out of a single bore from the surface, a nagging problem has remained unsolved. The basic problem addressed by the apparatus and method of the present invention is how to make use of an existing completed wellbore by deviating therefrom when the production from the wellbore has become marginal. This has become a problem because in completed wellbores, the tubing string and packer are set in a casing, limiting the access to the perforated zone to begin a deviation from the main wellbore. Typically, casing in the pay zone which plays out is in the order of $4\frac{1}{2}''$–$9\frac{5}{8}''$, with the tubing clearance being as small as about 1.995" I.D. Thus, any tool that is to be placed adjacent the played out perforation in the casing must be delivered to that site through the low clearance of the tubing that is set in place. Various through-the-tubing techniques have been attempted to facilitate the bore through the production tubing. Once such method has been to support a side-tracking tool that is lowered through the tubing below the outlet of the tubing as a guide to a milling machine or tool to create the deviated opening through the casing. This device usually consists of only a sliver of casing which is lowered through the tubing. The sliver, however, provides very little support for the milling tool and, as a result, the milling tool can easily roll off of either side due to the narrow width of the sidetracking apparatus, necessitated by having to pass it through the existing tubing.

Still other processes involve passing through the restriction with an inflatable packer or anchoring assembly and getting this device in the large diameter cavity. A whipstock device is either run concurrently or as a latch on mechanism during a subsequent trip. Unfortunately, the torque resistance and stability of the assembly is marginal due to the large gap which may exist between the anchor and casing I.D. As the inflatable wall is the only connection between the whipstock mandrel and casing wall, the gap determines the amount of rigidity. The larger the gap to bridge, the less rigid is the assembly and more likely is the later drilling assembly to fall off or twist the whipstock. The milling tools could even drill off the whipstock and puncture the inflatable element, resulting in loss of pressure, deflation, and loss of orientation. The hole would most likely be abandoned.

Accordingly, there exists a need for a reliable device and method to allow properly controlled deviations to be started in a completed well which has a packer and tubing string. Not only is there a need to deviate in one direction, but it is desirable in an existing well that has a packer and a tubing string to be able to deviate in different directions in the same elevation as well as at different elevations within the wellbore. The apparatus and method of the present invention also facilitate subsequent further extension of the original wellbore, should that become necessary.

SUMMARY OF THE INVENTION

The apparatus and method of the present invention facilitate the initiation of lateral bores from a main wellbore in a completed well having a packer and a tubing string. The preferred method involves setting a plug, which may be removed, through the tubing string, followed by a layer of sand, followed by a layer of cementitious material or other material that becomes hard. The cementitious material is drilled from the end of the production tubing by means of equipment passed through the length of the cementitious material. This allows running in with another packer or anchoring device to be located within the newly created bore in the cementitious material. The sidetracking device is secured to the anchoring device and oriented. The milling then proceeds with a high-efficiency milling tool that creates a window through the cementitious material and outer casing. A milling assembly can then be used to complete the window and begin the lateral bore. If subsequent bottom production is required, the cementitious material can be underreamed down to the sand. The sand can then be washed from the initial plug that was set to support the cementitious material in the original wellbore. Multiple laterals can be accomplished in this manner by repeating the process steps.

BRIEF DESCRIPTION OF THE DRAWINGS

FIG. 6 represents the orientation step with regard to the anchoring device installed in. FIG. 5.

DETAILED DESCRIPTION OF THE PREFERRED EMBODIMENT

Figure 1:
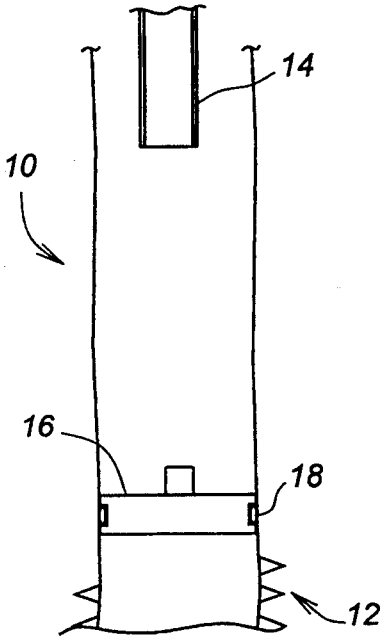
FIG. 1 is a schematic representation of a wellbore, illustrating the initial step in the method of the present invention.

The method of the present invention is illustrated in the figures. A segment of a wellbore casing 10 is illustrated in FIG. 1. The method, of the present invention, including the apparatus disclosed in the drawings and described herein, is equally applicable in situations involving open-hole as well as cased hole applications. In a typical well, the casing 10 is perforated, with the perforations 12 shown schematically. A tubing string 14 extends to above the area of the perforations 12. Those skilled in the art will appreciate that uphole and not shown, would be a production packer or equivalent. Accordingly, access through to the perforations 12 from the surface can occur through tubing 14. Typically, tubing 14 does not provide for a very large cross-sectional area through which to deliver to that zone adjacent perforations 12 apparatus for sidetracking which will accomplish the desired sidetracking in a reliable manner. Simply stated, equipment that is used below the bottom of tubing 14 must pass through it. Problems exist in sufficiently locating and fixating a bridge plug or packer or other support device for a sidetracking apparatus that will withstand the torques applied at the onset of the milling operation for penetration of the casing 10. This is because the applied torques from the milling tools are transmitted to the sidetracking apparatus which would be placed above the perforations 12 after having passed through the tubing 14. In order to be able to pass through the tubing 14, the ability to fixate against applied torque of any device which would lend support to a sidetracking apparatus has been problematic.

The method of the present invention, including the apparatus disclosed and described, involve a different approach from the unsuccessful attempts that have been made to initiate deviated wellbores from an existing production well. The initial step involves the installation and setting of an inflatable bridge plug or packer 16 or some other equivalent plugging device. In the preferred embodiment, the packer 16 can be removed to permit the method and to be used downhole at a later time, or to alternatively permit extending the original wellbore to other producing: formations further below the surface. The packer 16 may be installed by a variety of known techniques, such as wireline or coiled tubing (not shown). The packer 16 may also be set by conventional techniques, including pressure or mechanical forces. Once set, packer 16 effectively seals with seals 18 around the inside diameter of the casing 10.

Figure 2:
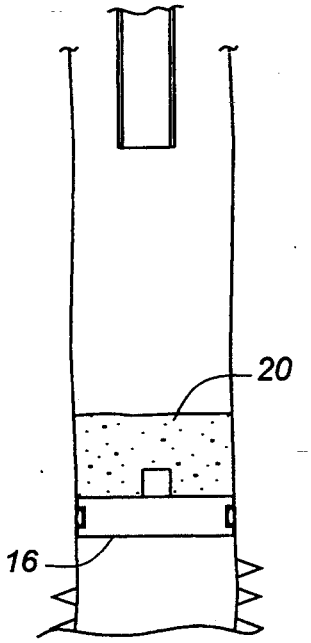
FIG. 2 illustrates the application of sand on top of the plug which is installed, shown in FIG. 1.
Figure 3:
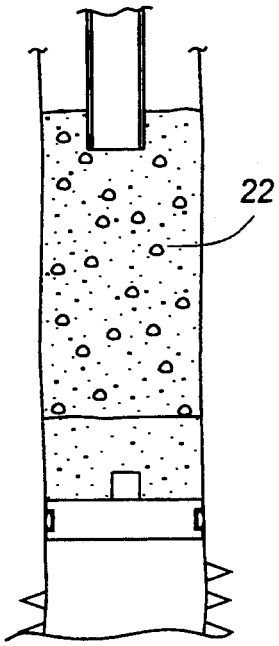
FIG. 3 represents the cementing operation.
Figure 4:
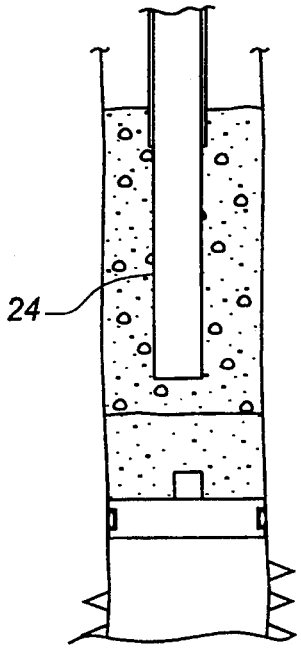
FIG. 4 represents the drill out operation.

As shown in FIG. 2, a layer of sand or other free flowing material 20 is deposited on top of packer 16. The sand 20 is spotted adjacent to packer 16 by conventional circulation, reverse circulation, or wireline placement techniques. The depth of the layer of sand 20 can be adjusted to meet the needs of the specific application without departing from the spirit of the invention. The layer of sand serves as an indicator of the proximity of the plug 16 in the removal process which will be described later. Once the sand 20 is deposited in place, a cementitious material or other plastic material or material that hardens with sufficient rigidity to withstand drilling, as shown in FIG. 4, and having the ability to maintain the integrity of a cavity so formed, is applied on top of the sand layer. The cementitious material 22 can be of a height as required by the application may be installed through the tubing and is preferably added until the bottom of the tubing 14 is covered with the material 22. Depending on the objectives, the height of the material 22 can be varied so that the turnout radius of the sidetrack bore to be drilled can be controlled to the desired value. Depending on the positioning of the new or existing formation to be penetrated with the sidetrack bore, such as that shown in FIG. 9, the height of the material 22 can be regulated to accommodate the necessary exit angle for the sidetracking operation. It should also be noted that a cementitious material is not required and various types of plastics or other materials with the fight degree of hardness and meeting the necessary brittleness requirement can also be used if they facilitate proper sidetracking. The important physical properties of the material 22 are that it should have sufficient compressive strength and cohesive strength to be able to bi e drilled, as shown in FIG. 4, so that the passage 24 can remain intact.

The next step is illustrated in FIG. 4 where a suitable drill or other boring device is inserted through the tubing 14 to drill a passage 24, in the manner shown in FIG. 4, through the cementitious material 22. The drilling can either be with a downhole motor or conventionally from the surface. The passage 24 does not penetrate the layer of sand 20. The diameter of the passage 24 closely approximates the inside diameter of the tubing 14 and is somewhat smaller.

Figure 5:
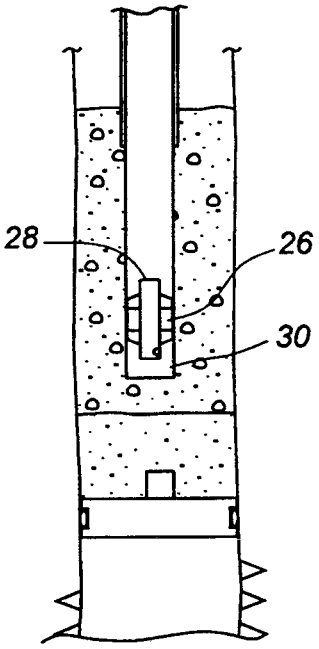
FIG. 5 represents the placement of a packer or other anchoring device in the drilled,out cementitious material.
Figure 6:
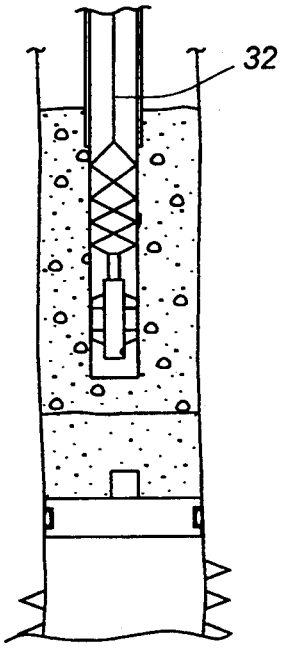

The next step is illustrated in FIG. 5, where a packer or other type of anchor or plug 26, which has an orientation key 28, is lowered into passage 24 and set adjacent its lower end 30. The next step requires the orientation of the key 28 using known techniques such as a wireline 32. Having properly determined the orientation of the key 28, the sidetracking device or whipstock 34 is put into position and latched to key 28. This procedure ensures the fixation of the whips lock 34, as well as its proper orientation. Other systems may combine these steps a d allow the whipstock, packer, anchor, and orienting device to be run and set together. This step is illustrated in FIG. 7.

The next step is to begin the drilling out operation using a mill 36, which is passed through tubing 14. The mill 36, shown in FIG. 7, is rotated and advances through the cementitious material 22 at the angle predetermined by the ramped surface 38 on whipstock 34. Eventually, the mill 36 penetrates the cementitious material 22 as well as the casing 10. This is illustrated in FIG. 8. Thereafter, the upper portion of the whipstock 34 is removed, as shown in FIG. 9, and a full bore milling assembly 40 is run through tubing 14 to open up the lateral passage 42 to a larger extent than the initial milling tool illustrated in FIGS. 7 and 8.

Figure 7:
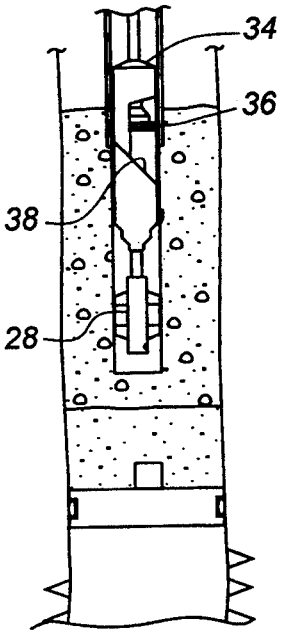
FIG. 7 represents the installation of the sidetracking device and the onset of the milling operation.
Figure 8:
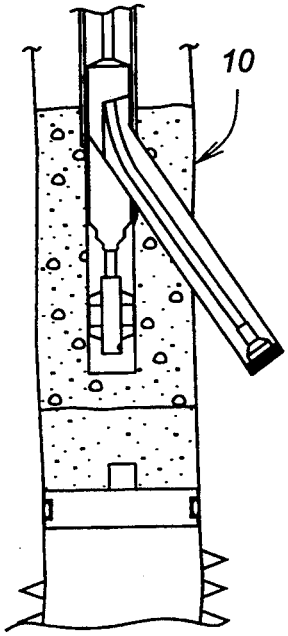
FIG. 8 represents the milling operation initiating a sidetrack bore through the casing.
Figure 9:
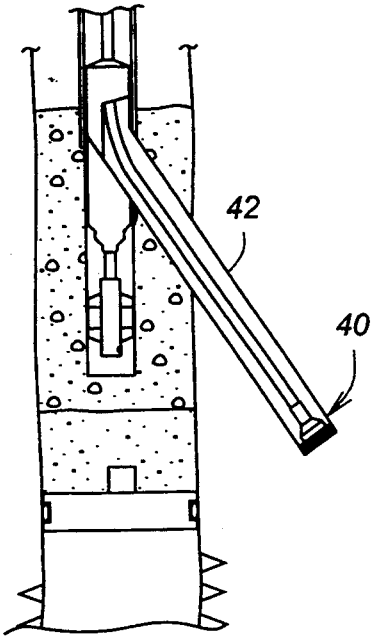
FIG. 9 illustrates full bore milling continuing from the initial drilling out of the cementitious material and casing.

Alternatively, and within the scope of the invention, a singular bit may be used to accomplish the steps illustrated in FIGS. 7–9 without departing from the spirit of the invention. A singular bit to accomplish the initial penetration of the cementitious material 22 as well as the casing 10, which could continue to then create the sidetrack bore 42, would save rig time by avoiding a trip out of the hole for a change of equipment.

Figure 10:
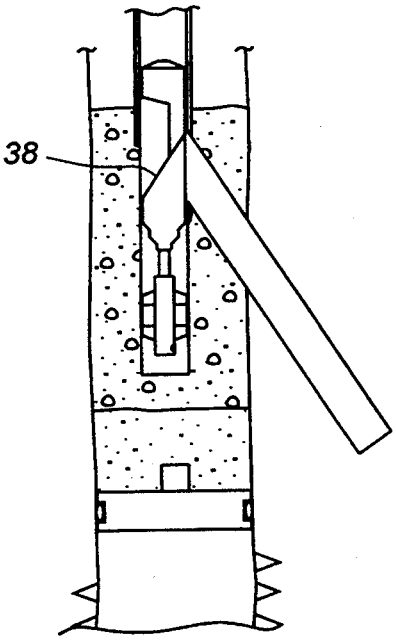
FIG. 10 illustrates an optional second positioning of the sidetracking apparatus.
Figure 11:
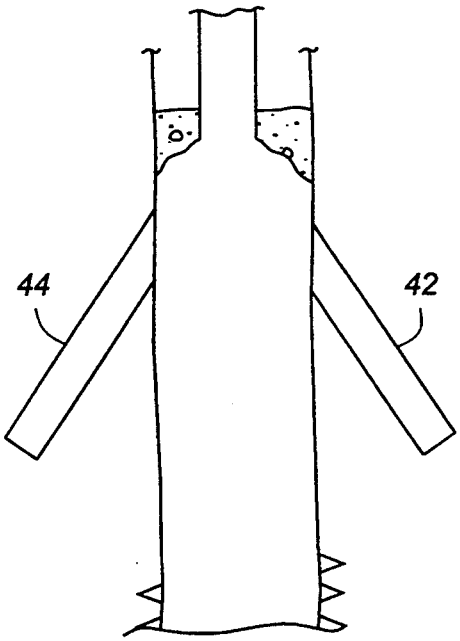
FIG. 11 represents the plurality of sidetrack bores producible with the apparatus and method of the present invention, as well as the initial packer or bridge plug removed subsequent to removal of the cementitious material.

If additional sidetrack passages 42 are desired, the entire whipstock assembly 34 can be removed from the wellbore and repositioned after adjusting the position of the latch which engages the orientation key 28. The whipstock 34 can be reinserted in an alternative position, as shown in FIG. 10. Thereafter, the milling steps as described above can be repeated and another passage 44 can be created from the main bore represented by casing 10. If there is a need to extend the original bore represented by casing 10, the packer 26 and orientation latch 28, as well as whipstock 34, can be removed from the wellbore, and the cementitious material 22 can be milled so that it fragments and breaks for removal from the wellbore. The milling continues until the layer of sand 20 is penetrated. The driller can then detect by the decreased resistance that the entire cementitious layer 22 has been fully milled without destruction of the bridge plug or packer 16. Thereafter, by virtue of circulation or reverse circulation, the cementitious fragments 22 and the sand 20 can be circulated or reverse circulated out of the wellbore. Thereafter, in a reverse of the step illustrated in FIG. 1, the , plug 16 is grabbed and seals 18 are disengaged from casing 10. Thereafter, the plug or packer 16 can be physically removed from the wellbore through the tubing 14 in the reverse of the manner in which it was originally installed.

The advantage of the apparatus and method A as illustrated above should be readily apparent to those skilled in the art having read the preceding; disclosure. The use of the cementitious material 22 to create the passage 24 lends support for a packer 26 and a standard whipstock 34. The deviated bore 42 or 44 can be oriented with confidence, knowing that the milling tool 36 or 40 can follow the proper track. Multiple deviated bores can be accomplished in an existing well. The bottom plug can be retrieved so that the initial wellbore can be further extended. The use of the cementitious material 22 provides a secure passageway 24 the the plug or anchor 26, thereby allowing use of standard whipstock hardware 34 in a through the tubing installation. The problem of inability of prior art methods and devices to withstand the torsional loads applied during the milling operation, when confronted with an existing well application, has been overcome by the apparatus and method of the present invention. In the preferred embodiment, the cementitious material 22 is preferably a cement such as that supplied by Halliburton and classified as 50—50 poz mix.

Alternatively, a plastic material, such as Epseal, also supplied by Halliburton, can be used in lieu of the cementitious material previously described.

The foregoing disclosure and description of the invention are illustrative and explanatory thereof, and various changes in the size, shape and materials, as well as in the details of the illustrated construction, may be made without departing from the spirit of the invention.

I claim:

1. A method of sidetracking an existing well having a tubing therein, comprising the steps of:

inserting a support;

adding material on top of said support;

forming a support base for a diverting tool at least in part within said material;

installing a diverting tool to said support base;

milling against the said material laterally by use of the diverting tool;

creating a sidetrack by said milling.

2. The method of claim 1, wherein:

said adding material step further comprises:

adding a material which is flowable through the tubing and thereafter hardens to provide support for said diverting tool.

3. The method of claim 2, further comprising:

creating a longitudinal penetration in said material to serve at least in part as said support base.

4. The method of claim 3, further comprising the steps of:

inserting an anchoring device for the diversion tool into said penetration;

securing the anchoring device within said penetration.

5. The method of claim 4, further comprising the step of:

determining the orientation of said anchoring device to ascertain the orientation of said diverting tool when mounted thereto.

6. The method of claim 5, further comprising the steps of:

adding a softer substance on said support before the addition of said material;

removing the diverting tool after said lateral milling;

longitudinally milling through said material toward said substance;

using the decreased resistance to milling when said substance is reached as a signal that the mill is approaching the support.

7. The method of claim 6, further comprising the steps of:

using a first mill inserted into said penetration for rapid milling through said material and initial penetration into any well casing;

using a larger bore second mill to continue penetration through any casing.

8. The method of claim 7, further comprising the step of:

removing at least a portion of said diverting tool to facilitate use of said second mill.

9. The method of claim 8, further comprising the steps of:

reorienting said diverting tool with respect to said support base;

creating at least another one sidetrack by said milling.

10. The method of claim 1, further comprising the steps of:

reorienting said diverting tool with respect to said support base;

creating at least another one sidetrack by said milling.

11. A method of sidetracking an existing well having a tubing therein, comprising the steps of:

blocking off perforations in an existing portion of the well;

providing temporary support for at least the periphery of a diverting tool above said blocking off;

inserting a diverting tool at least in part into said temporary support;

milling a sidetrack from the existing wellbore by virtue of said diverting tool.

12. A method of sidetracking an existing well having a tubing string therein, comprising the steps of:

blocking off perforations in an existing portion of the well;

providing temporary support for at least the periphery of a diverting tool above said blocking off by installing through said tubing a material which is hardenable with time;

providing a penetration in said temporary support when hardened;

securing the diverting tool to said penetration;

milling a sidetrack from the existing wellbore by virtue of said diverting tool.

13. The method of claim 12, further comprising the steps of:

inserting an anchor which can support said diverting tool into said penetration;

securing said anchor to the wall of said penetration;

mounting the diverting tool to said anchor.

14. The method of claim 13, further comprising the step of:

determining the orientation of at least one of said anchor and said diverting tool prior to milling.

15. The method of claim 14, further comprising the step of:

reorienting said diverting tool with respect to said penetration to mill additional sidetracks.

16. The method of claim 14, further comprising the steps of:

inserting a buffer substance first before adding said material;

milling longitudinally through said material after said sidetrack milling;

using decreased resistance to longitudinal milling as said buffer substance is penetrated as a signal that all the material has been milled;

removing the material and the buffer substance from the wellbore.

17. The method of claim 14, further comprising the steps of:

using a first mill to penetrate at least a portion of said temporary support and any casing;

removing at least a portion of the diverting tool;

continuing milling with a larger bore mill along the path of said first mill.

18. The method of claim 14, further comprising the step of:

inserting said anchor and said diverting tool at one time.

19. The method of claim 14, wherein:

said anchor is a through-the-tubing inflatable packer, having an orientation key for said diverting tool;

determining the orientation of said key;

installing said diverting tool to said anchor as oriented by said key.

20. A method of sidetracking an existing well having a tubing string therein, comprising the steps of:

blocking off perforations in an existing portion of the well;

providing temporary support for at least the periphery of a diverting tool above said blocking off;

inserting a diverting tool at least in part into said temporary support;

milling a sidetrack from the existing wellbore by using a first mill to penetrate at least a portion of said temporary support and any casing;

removing at least a portion of the diverting tool;

continuing milling with a larger bore mill along the path of said first mill.

* * * * *